United States Patent [19]

Stoddard

[11] 4,232,465

[45] Nov. 11, 1980

[54] ILLUMINATED DISPLAY STAND

[76] Inventor: Ione Stoddard, 1501 S. Flagler Dr., Suite 8-F, West Palm Beach, Fla. 33401

[21] Appl. No.: 959,403

[22] Filed: Nov. 9, 1978

[51] Int. Cl.[3] ..... G09F 13/18

[52] U.S. Cl. ..... 40/546; 362/31

[58] Field of Search ..... 40/546, 547, 553, 540; 362/31, 32

[56] References Cited

U.S. PATENT DOCUMENTS

| | | | |
|---|---|---|---|
| 2,080,259 | 5/1937 | Frei | 40/540 X |
| 2,162,998 | 6/1939 | Fisher | 40/540 |
| 2,199,434 | 5/1940 | Koonz | 362/31 |
| 2,316,589 | 4/1943 | Iwanowicz | 362/32 |
| 2,651,863 | 9/1953 | Howenstine | 40/553 X |

FOREIGN PATENT DOCUMENTS

| | | | |
|---|---|---|---|
| 817194 | 5/1937 | France | 40/546 |

*Primary Examiner*—John F. Pitrelli

*Attorney, Agent, or Firm*—Beveridge, DeGrandi, Kline & Lunsford

[57] ABSTRACT

A lamp is located in a housing which has a top wall formed of a sheet of light-conducting material, silvered on its internal surface, and having a light emitting hole for internally illuminating a transparent object d'art placed thereon. Light striking the edge of the hole is transmitted by the sheet to the beveled perimetral edges of the top where the conducted light is emitted. One side wall has an opening which provides an edge for receiving light which is emitted from the side wall perimeter.

9 Claims, 3 Drawing Figures

FIG.1
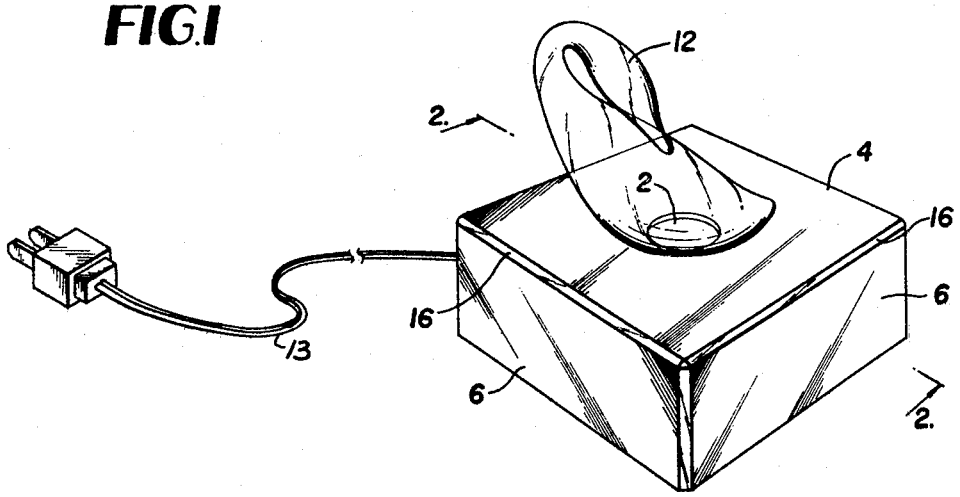
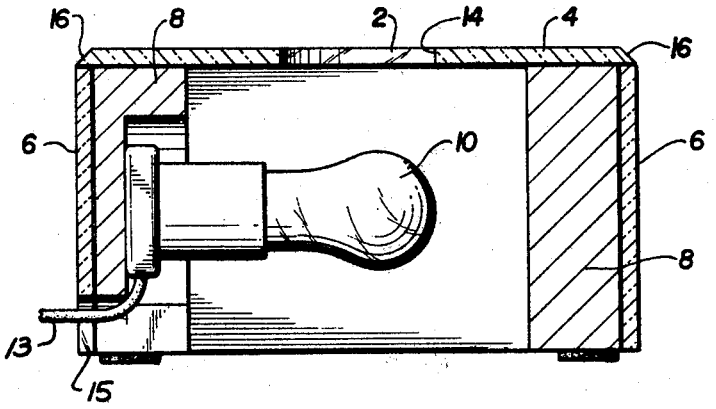
FIG.2
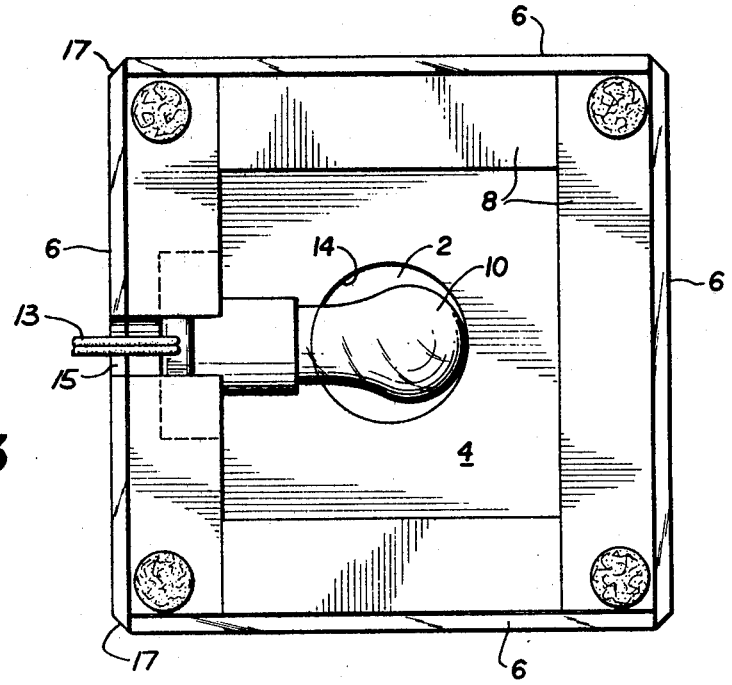
FIG.3

ILLUMINATED DISPLAY STAND

BACKGROUND AND SUMMARY OF THE INVENTION

This invention relates to an illuminated display stand for supporting, internally illuminating and enhancing the appearance of a transparent objet d' art placed thereon.

One type of prior display stand has included a lamp-enclosing box with an object-supporting top provided with a light-emitting opening so that an object placed thereon will be internally illuminated. Such prior devices have not been mirrored or capable of providing an illuminated edge at their perimeter. A preliminary patentability search, made with the benefit of hindsighted knowledge of this invention, located devices in different fields possessing an illuminated-edge effect, these being typified by the disclosures of U.S. Pat. Nos. 2,199,434, 3,000,774, 3,752,974 and 3,828,182.

According to the present invention, an illuminated stand for displaying transparent objects comprises a light source, an enclosure, a top wall located above the light source and side walls laterally enclosing the light source. The top wall has an opening in the path of light from the light source so that a transparent object placed over the opening will be internally illuminated. A characterizing feature of the invention is that one of the walls includes a piece of light-conducting material which has a light-receiving edge in the path of light from the light source and a light-emitting edge which is visible from the exterior of the enclosure to provide the stand with an illuminated edge. Preferably, the light-receiving edge faces the opening in the top wall, and the top wall has a quadrilateral shape with four beveled light-emitting edges. Also, it is preferred that the top wall has a silvered surface to give a mirror effect to enhance the appearance of the displayed object.

A more complete understanding of the invention may be had from the following description and the accompanying drawings which illustrate only one preferred embodiment.

THE DRAWINGS

FIG. 1 is a perspective view of a device constructed according to the invention while in use, displaying an object of glass sculpture.

FIG. 2 is a sectional view of the device of FIG. 1.

FIG. 3 is a bottom view of the device of FIG. 1.

DESCRIPTION OF A PREFERRED EMBODIMENT

As illustrated in FIG. 1, the illuminated stand of this invention is to display a glass sculpture 12 or other transparent objet d' art. The stand resembles prior structures in that it includes an electric lamp or other light source located in a box-like enclosure, the top of which has an opening for projecting light into a transparent sculpture placed thereon. The enclosure includes a quadrilateral top wall 4 and vertical side walls 6 which laterally enclose the lamp 10. Walls 4 and 6 are formed of flat sheets of a light-transmitting transparent material such as glass or Lucite, silvered on their internal surfaces to give a mirror effect. A frame 8 formed of wood or particle board provides the necessary strength. As shown in FIGS. 2 and 3, the electric lamp 10 is located within the enclosure, beneath an opening 2 in top 4 in order to project light upwardly against and into the transparent object 12 positioned thereover. The lamp 10 is mounted in a socket 11 which is connected to a conventional electric cord 13 which enters the enclosure through an opening 15.

Light emitted by the lamp 10 also strikes the light-receiving edge 14 of opening 2. This light is transmitted internally within the transparent material of top wall 4 to its perimeter defined by the four visible beveled edges 16. At these edges, the light is emitted, surrounding the stand to provide a pleasing and attractive effect, especially when coupled with the mirrored effect of the top wall 4. There is also an edge-illuminating effect on two of the four vertical edges of the display stand, this effect being produced because the opening 15 for cord 13 is also located in the path of direct or reflected light from the lamp 10. The edge of opening 15 receives the light which is then transmitted through the respective side wall 6 and emitted at the vertical surfaces which are designated 17 in FIG. 3, these surfaces being visible from the exterior of the enclsoure to provide the stand with these illuminated edges.

A stand constructed according to the invention will have a most attractive and pleasing appearance, enhancing the appearance of any object 12 placed thereon. The stand not only internally illuminates the object but provides a reflected image, surrounded by the illuminated beveled edges 16 and, if desired, at least two illuminated vertical edges associated with the cord-accommodating side wall 6.

Skilled persons will realize that the invention may be practiced by a variety of devices which differ substantially in construction and appearance from the illustrated preferred embodiment. Therefore, it is emphasized that the invention is not limited only to the disclosed embodiment but is embracing of a wide variety of alternative devices which fall within the spirit of the following claims.

I claim:

1. An illumiated stand for displaying transparent objects which are placed thereon, comprising, a light source, an enclosure for said light sorce, said enclosure having a top wall located in a substantially horizontal plane spaced above said light source, said enclosure including side walls laterally enclosing said light sorce, said top wall having an opening in the path of light from the light source so that a transparent object placed over said opening will be internally illuminated, at least one of said walls including a piece of light-conducting material which has a light-receiving edge in the path of light from the light source and a light-emitting edge which is visible from the exterior of the enclosure to provide the stand with an illuminated edge, whereby said light source produces the illumination of both said illuminated edge and an object placed on said top wall over said opening.

2. The illuminated stand of claim 1 wherein the top wall has a quadrilateral shape with four said light-emitting edges.

3. The illuminated stand of claim 1 wherein the light emitting edge is beveled.

4. The illuminated stand of claim 1 wherein said top wall includes said piece of transparent material, said light-receiving edge being the edge of said opening.

5. The illuminated stand of claim 1 wherein a said light source is an electric lamp, a lamp cord conected to said lamp, said side wall includes said piece of transparent material, an opening in said piece of transparent material, said lamp cord extending through said opening, said light-receiving edge being the edge of said opening whereby the light-emitting edge is located on the perimeter of said side wall.

6. The illuminated stand of claim 5 wherein the light emitting edge is beveled.

7. The illuminated stand of claim 5 wherein the piece of transparent material has an internal surface which is silvered to give a mirror effect.

8. The illuminated stand of claim 5 wherein the top wall has a quadrilateral shape with four said light-emitting edges.

9. The illuminated stand of claim 8 wherein the light emitting edge is beveled.

* * * * *